US005215508A

United States Patent [19]

Bastow

[11] Patent Number: 5,215,508

[45] Date of Patent: Jun. 1, 1993

[54] ANKLE REHABILITATION DEVICE

[76] Inventor: Jack Bastow, 31 Buckingham Dr., Albany, N.Y. 12208

[21] Appl. No.: 891,197

[22] Filed: Jun. 1, 1992

[51] Int. Cl.[5] ..... A63B 23/08; A63B 21/008

[52] U.S. Cl. ..... 482/79; 482/112; 602/27

[58] Field of Search ..... 482/79, 111, 112; 602/27; 128/25 B

[56] References Cited

U.S. PATENT DOCUMENTS

| | | | |
|---|---|---|---|
| 3,020,046 | 2/1962 | Horas | 482/79 |
| 4,186,920 | 2/1980 | Fiore et al. | 482/79 |
| 4,605,220 | 8/1986 | Troxel | 482/79 |

FOREIGN PATENT DOCUMENTS

| | | | |
|---|---|---|---|
| 1289516 | 2/1987 | U.S.S.R. | 482/79 |
| 1454461 | 1/1989 | U.S.S.R. | 128/80 H |

*Primary Examiner*—Richard J. Apley
*Assistant Examiner*—Lynne Reichard
*Attorney, Agent, or Firm*—Heslin & Rothenberg

[57] ABSTRACT

A device is disclosed that is able to isolate the ankle and subtalar joint complex and exercise those muscles directly responsible for inversion and eversion of the subtalar joint as well as those responsible for dorsal and plantar flexion of the ankle joint. The device uses fluid chambers for hydraulic resistance, a modified foot orthosis to create the proper mechanical advantage to allow the chambers to effectively resist the proper muscles, and a leg brace to isolate the ankle and subtalar joint. A method for strengthening an ankle, using the foregoing device, is also disclosed.

9 Claims, 5 Drawing Sheets

ANKLE REHABILITATION DEVICE

BACKGROUND OF THE INVENTION

1. Field of the Invention

The invention relates to an apparatus and a method for the physical therapy of an ankle.

2. Information Disclosure

Ankle injuries are a very common problem in almost all types of athletic endeavors. This group of injuries range from the most mild class 1 inversion ankle sprain to the most severe trimalleolar fractures. In all cases there is loss of integrity of the supporting soft tissues, including ligaments, tendons, and muscles. When any of these structures has been disrupted, there is always a degree of disability which is proportional to the severity of the injury. The objective of therapy is to return the patient to normal activity.

After an acute injury, control of pain and swelling are paramount in beginning rehabilitation. As soon as the pain has subsided, range-of-motion exercises are initiated. In these early stages it is important to protect those movements which are painful and encourage those movements that are not. Devices are known for this phase of treatment. Once the full range of motion is achieved with no discomfort, strengthening of the musculature is begun. Since ligaments generally heal through fibrosis and scarring, rehabilitation of the musculo-tendinous structures is crucial to increasing the stability of the joint. Exercises to extend the range of motion against resistance are required, as well as proprioception exercises to "re-educate" the muscles via the muscle spindle fiber mechanisms.

The earliest range-of-motion exercise is usually passive and devices are specially designed to protect the injured structures. The next phase of rehabilitation involves range of motion exercises against resistance. Initially the amount of resistance must be extremely small because the strength of the affected structures is very limited. It is, however, important to use the full range of motion of the joint regardless of the resistance used. As the patient gains strength in the joint, more resistance will be necessary.

Motion in the area commonly referred to as the ankle joint, is in fact the product of two separate and distinct joints which work together. A first type of motion in this area is dorsiflexion and plantarflexion. Dorsiflexion can be defined as motion occurring in the sagittal plane during which the distal aspect or end of the foot moves toward the tibia or the front of the leg. (See FIG. 3) Plantarflexion can be defined as motion occurring in the sagittal plane during which the distal aspect of the foot or toes move away from the front of the leg, commonly called pointing the toes (See FIG. 4)

The other motions commonly associated with the ankle joint do not in fact take place in the ankle joint itself. They are created at the subtalar joint. The subtalar joint is comprised of the inferior surface of the talus, that bone that sits in the ankle mortice, and the superior surface of the calcaneus, or heel bone. Because of the axis of this joint, motion from this joint goes through all of the three planes of the body. The motions are referred to as pronation and supination. Supination consists of plantarflexion, inversion and adduction. (FIG. 5) Pronation consists of dorsiflexion, eversion and abduction. (FIG. 6)

Inversion and eversion are frontal plane motions. Inversion is motion where the sole of the foot tilts so as to face the midline of the body. (FIG. 7) Conversely, eversion is motion where the sole of the foot tilts away from the midline to the body (FIG. 8).

Abduction is transverse plane motion where the end of the foot moves away from the midline of the body whereas adduction is when the end of the foot moves toward the midline of the body.

The amount of dorsi- and plantarflxion at the subtalar joint is very small; dorsi- and plantarflexion are primarily ankle joint motions. Because of the axis of the subtalar joint, most of its motion is in the direction of inversion/adduction and eversion/abduction. In this way, the ankle/subtalar joint combination works to create all of the motions of the ankle region. For the purpose of the ankle rehabilitation device of the invention, the most important range of motion to focus on is inversion and eversion.

The most common type of ankle injury is the "ankle sprain." This happens when the foot contacts the ground in the plantarflexed and inverted position. As this happens those structures on the lateral aspect of the ankle and subtalar joint, whose function it is to prevent excessive motion in this direction, can be damaged to varying degrees. The more severe the injury, the greater degree of damage and disability. Because the ankle joint is more stable anteriorly, little disability will result in the direction of dorsiflexion and plantar flexion. Therefore the most painful motions lost will be inversion and eversion at the subtalar joint. It is these motions which are strengthened by the ankle rehabilitation device of the invention. (FIGS. 9 and 10)

Three general types of exercise have been recognized: isotonic, isometric and isokinetic. Isotonic exercise involves contraction of the muscles against a fixed resistance or load. As a result of the variable length of lever arm formed by the bone structure in the human body, the forces that must be exerted by the muscles vary while the load remains constant. Therefore, the load must be selected to permit movement during the weakest portion of the body motion and the muscles undergo the strongest contractions only during a short portion of the total movement in the body.

Isometric exercise involves the muscular exertion of portions of the body against a load which is stationary and immobile. While this type of exercise permits the maximum contraction of the muscles employed, the body is prevented from any motion.

Isokinetic exercise resolves the problems noted above with isotonic and isometric exercising. In isokinetic exercising, the muscles of the body exert a force against a load or resistance which is moving at essentially a constant velocity and relatively independent of the actual force exerted by the muscles. Therefore, for rehabilitation and exercise of the ankle, a device permitting isokinetic exercises is preferable.

Devices for ankle rehabilitation are found at each end of the spectrum with regard to sophistication, efficacy and cost. At the inexpensive and unsophisticated end are mechanisms like the Theraband® System. In this system, a series of straps which have varying amounts of resistance are used. A multitude of logistical problems arise that make this system limited: First, it requires extra apparatus to provide stability to the joints above and below the joint the exercise is designed for, i.e. if one is strengthening the ankle, there is no way to intrinsically stabilize the leg. Second, unless one is meticulous about measuring the distance of the affected part from the stationary part, inconsistencies will arise from session to session. Finally, to strengthen the medial musculature, one must be very imaginative in setting up the exercise. The Theraband® System for the ankle appears to be able to concentrically and eccentrically exercise the lateral aspect of the joint only.

U.S. Pat. No. 2,467,943 (Mikell) discloses an exercise device for correcting weakened or flabby conditions of the lower leg and foot. The device comprises a pair of foot engaging members which are adapted to engage a patient's foot just back of the ball and under the toes, respectively. A pair of springs and a strap passing over the knee of the patient are attached to the foot engaging members such that a patient may exercise muscles in the leg and foot by overcoming the tension of the springs. The exercise resulting from the use of the Mikell device is isotonic. Moreover, because of the application of force at the ball of the foot, the extensor halluces longus and the peroneus longus are strengthened rather than concentrating the effort on the posterior tibial tendon and the peroneus brevis.

U.S. Pat. No. 5,013,037 (Stermer) discloses a physical therapy device for the rehabilitation of a limb. FIG. 6 discloses a modification of the device for exercising the calf muscles of the leg by flexing or stretching the toe and foot. It is similar in principal and operation to the device of Mikell.

U.S. Pat. No. 3,976,057 (Barclay) discloses a flexing apparatus for joint therapy. The apparatus comprises a plurality of straps holding a linkage means (hinge) and connected by a pneumatic cylinder assembly which may provide active displacement or passive resistance. Because of the hinge, motion is possible in one plane only.

U.S. Pat. No. 4,294,238 (Woodford) discloses a device for assisting and relaxing a user's leg muscles after physical activity. The device includes an elastic strap which extends from under the sole of the user's foot upwardly around the heel to the back of the knee. The elastic strap provides a biasing of the user's foot for assisting the leg muscles.

U.S. Pat. No. 4,371,161 (Williams) describes an ankle and foot exercise apparatus in which a structure attached to the lower leg and a structure that encircles the ball of the foot are connected by an elastic member allowing the foot and ankle to be exercised by moving against the resistance provided by the elastic member. As before, the exercise is isotonic and the wrong muscle groups receive the bulk of the exercise Although motion is allowed along any axis, only flexion works against resistance.

U.S. Pat. No. 4,411,422 (Solloway) discloses an aquatic exercise device comprising a series of sections having rearwardly extending inner fins and generally V-shaped fins that extend outwardly. The device is intended for use when the foot is immersed in water and moved through the water as a source of resistance. It provides isokinetic exercise.

U.S. Pat. No. 4,930,767 (Hamm) discloses a therapeutic device for relieving tension or spasms in the lower back of the human body. The device comprises a foot engaging part, a band to be wrapped above the knee and a pair of elastic straps extending therebetween. It is similar to the devices of Mikell and of Stermer in principle and operation.

At the other end of the rehabilitation spectrum are devices such as that disclosed in U.S. Pat. No. 4,452,447 (Lepley and LaCroix) which discloses a floor-mounted ankle exercising device. The device comprises a frame holding a foot plate which is capable of motion in three perpendicular axes. The motion is controlled by a series of hydraulic cylinders which are in turn controlled by a series of hydraulic valves operated by a series of controls mounted on a vertical extension of the frame. The device permits isokinetic exercise but it is large, complex, and expensive.

There is thus a need for a device which isolates and isokinetically exercises the ankle and subtalar joint complex simply and relatively inexpensively.

SUMMARY OF THE INVENTION

It is an object of the invention to provide an inexpensive device for isolating and rehabilitating the ankle and subtalar joint complex.

It is a further object to provide a simple isokinetic exercise device for the ankle.

It is a further object to provide a method for at-home physical therapy of an ankle joint that uses isokinetic exercise.

In one aspect the invention relates to a device for the physical therapy of an ankle and subtalar joint comprising:

(a) a rigid, foot-engaging member for attaching snugly to a foot. The foot-engaging member includes first and second rigid wings which extend medially and laterally from the foot. The first wing has a means for pivotally attaching a fluid chamber preferably at a point medially substantially in the frontal and transverse planes and opposite the navicular tuberosity, and the second wing has a means for pivotally attaching a fluid chamber preferably at a point laterally substantially in the frontal and transverse planes and opposite the styloid process of the 5th metatarsal base. pl (b) a first fluid chamber structure comprising a cylinder, a piston, and a piston rod. The travel of the piston through the full length of the cylinder defines one stroke. One of the cylinder and the rod is attached to the fluid chamber attaching means on the first wing.

(c) a second fluid chamber structure comprising a cylinder, a piston, and a piston rod. One of the cylinder and the rod is attached to the fluid chamber attaching means on the second wing.

(d) a leg enclosure for attaching snugly to a leg at a point between an ankle and a knee. The leg enclosure has first and second means for pivotally attaching the first and second fluid chamber structures respectively at the other of the cylinder and the rod.

The first and second foot-engaging member wings extend outwardly a sufficient distance such that the points of attachment of the first and second fluid chambers allow travel of the piston preferably through not less than 20% of a stroke by normal inversion or eversion of the foot.

In a preferred embodiment, the points of attachment of the fluid chambers to the wings are a distance of 5 to 13 cm from the foot, and the points of attachment on the wings are about 17 to about 20 cm from the means for attaching the fluid chambers to the leg enclosure.

The device preferably includes strap means for securing a foot in a firm and aligned position with the foot-engaging member and includes means for regulating resistance of fluid movement within the fluid chamber structures.

In a preferred design, the wings extend medially and laterally along an axis substantially in the frontal and transverse planes, and the means for attaching the fluid chamber structures to the leg enclosure are located along a common axis passing through the leg in the frontal and sagittal planes.

The invention further relates to a method for strengthening an ankle comprising:

(a) securing opposite ends of a pair of fluid chambers to a foot and lower leg respectively such that inversion, eversion, dorsal flexion and plantar flexion of the foot with respect to the leg result in compression and extension of the fluid chambers, and (b) inverting, everting and flexing the foot against a resistance provided by the chambers.

A more detailed explanation of the invention is provided in the following description taken in connection with the accompanying drawings.

BRIEF DESCRIPTION OF DRAWINGS

FIG. 11 is a schematic representation of the invention showing the placement of the wings, brace and compression of the pump system during inversion/plantarflexion with compression on the medial side. FIG. 12 illustrates the corresponding eversion/dorsiflexion with compression on the lateral side.

DETAILED DESCRIPTION OF PREFERRED EMBODIMENTS

Figure 1:
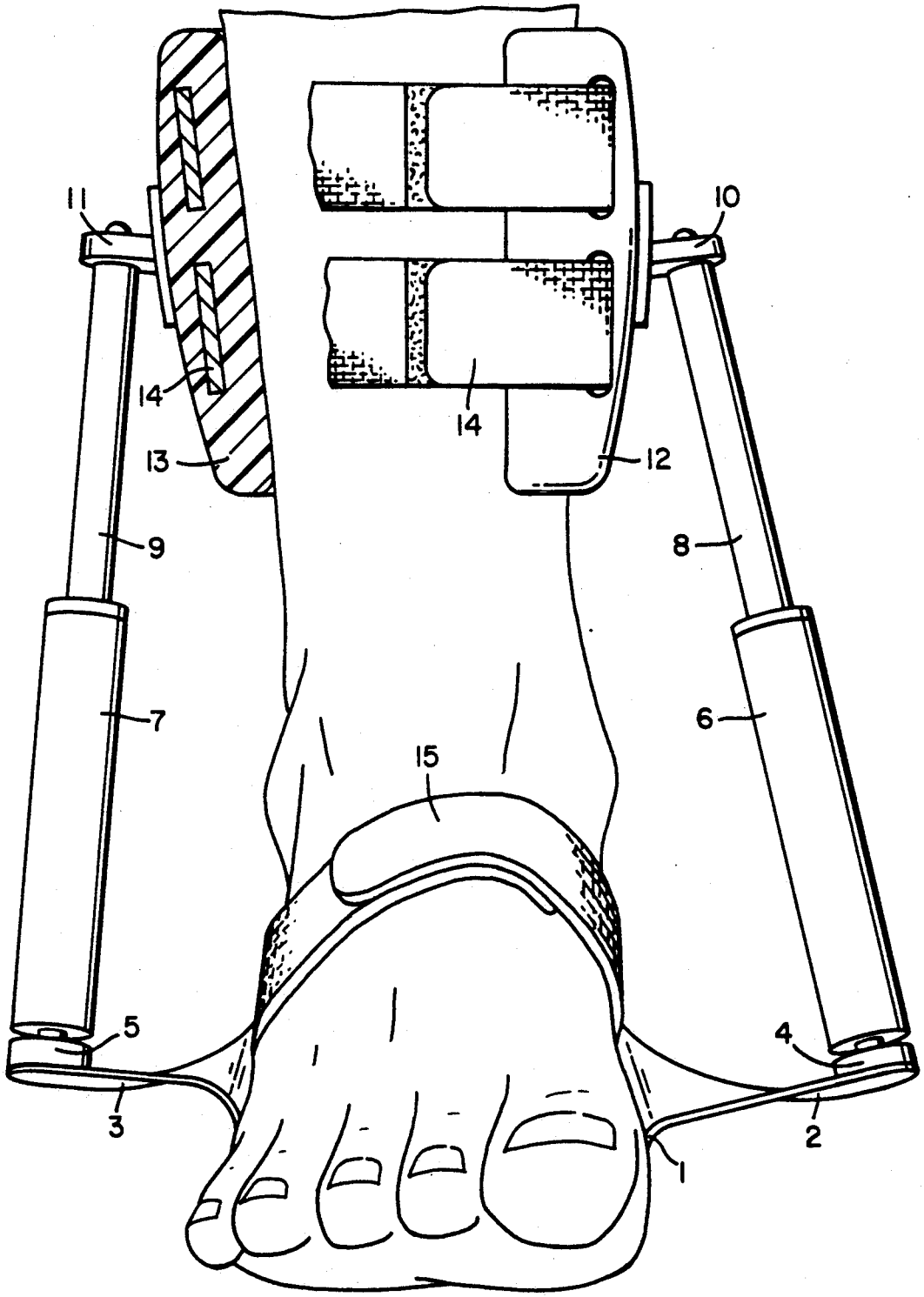
FIG. 1 is a front view of a device of the invention attached to an ankle.
Figure 2:
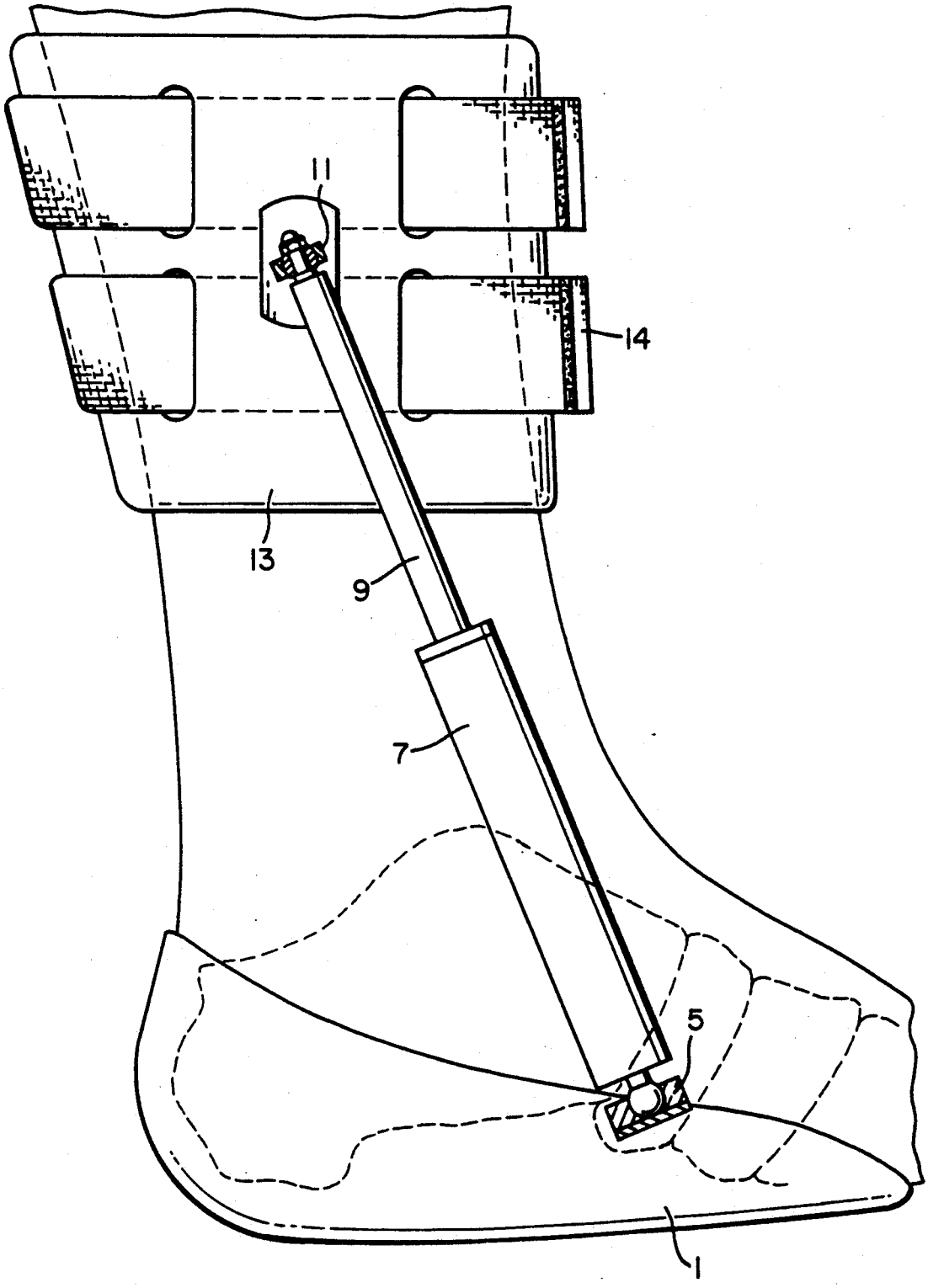
FIG. 2 is a side view of a device showing the location of its principle elements with reference to internal structures of the human foot.
Figure 3:
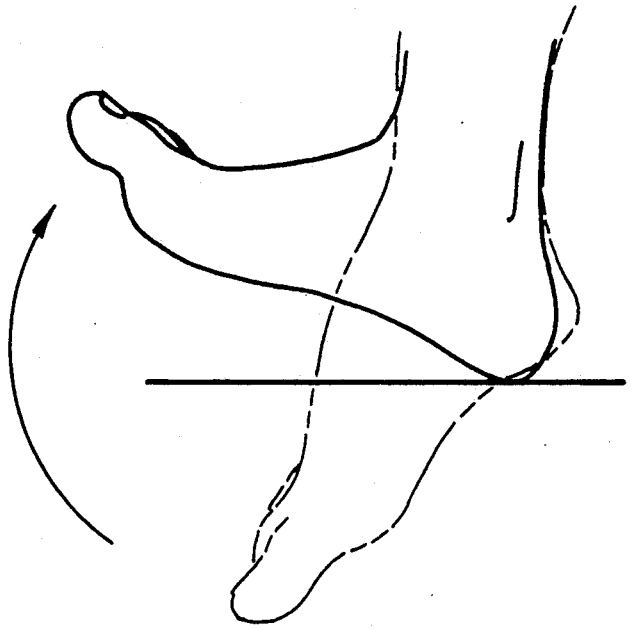
FIG. 3 is an illustration of dorsiflexion.
Figure 4:
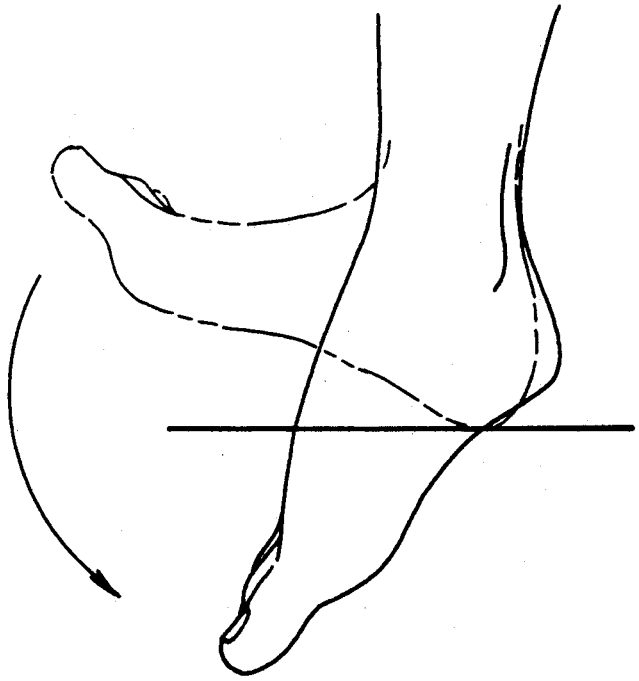
FIG. 4 is an illustration of plantarflexion.
Figure 5:
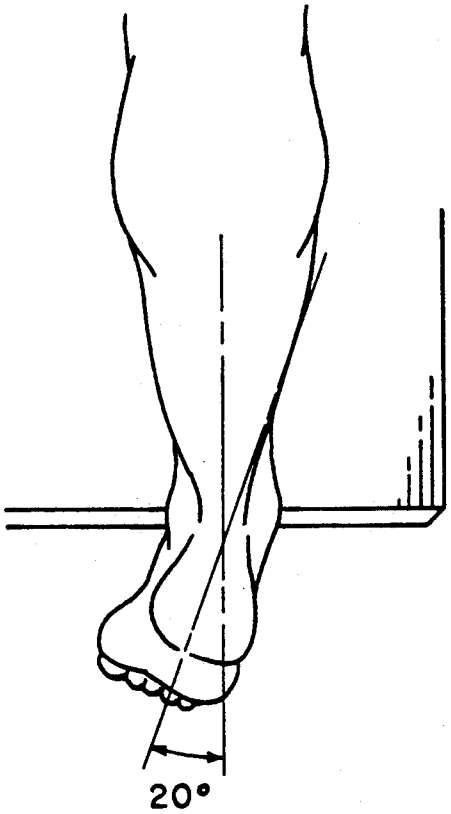
FIG. 5 is an illustration of supination.
Figure 6:
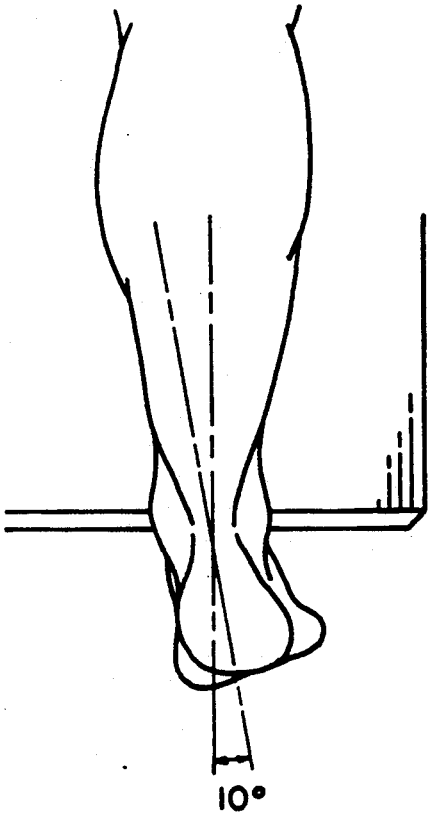
FIG. 6 is an illustration of pronation.
Figure 7:
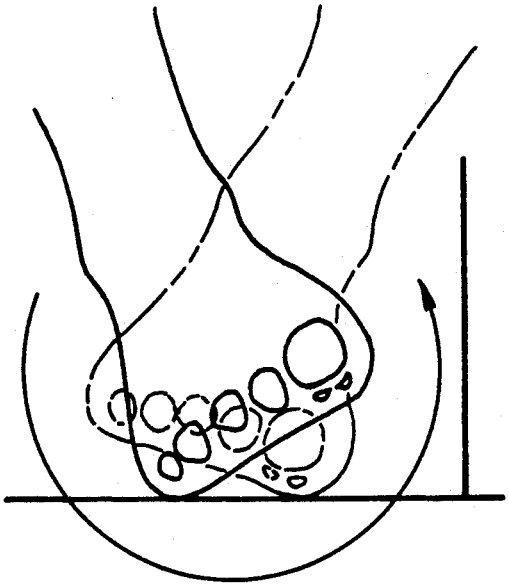
FIG. 7 is an illustration of inversion.
Figure 8:
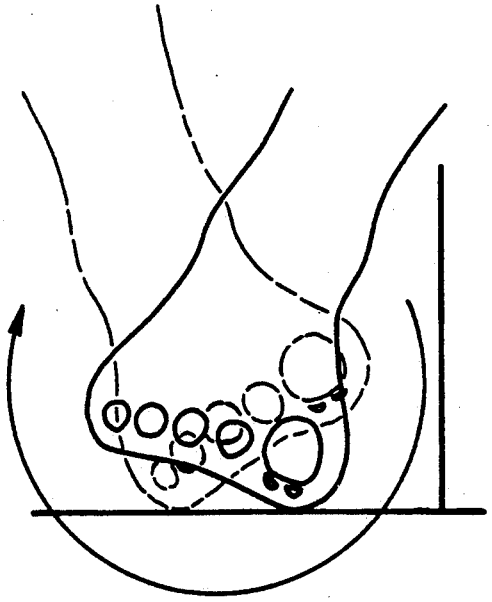
FIG. 8 is an illustration of eversion.
Figure 9:
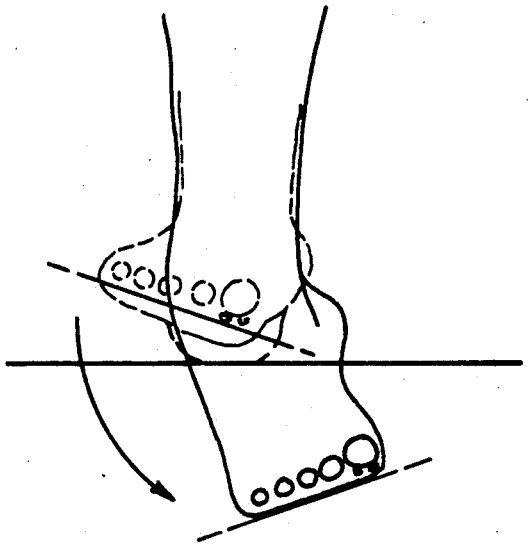
FIG. 9 is an illustration of inversion/plantarflexion.
Figure 10:
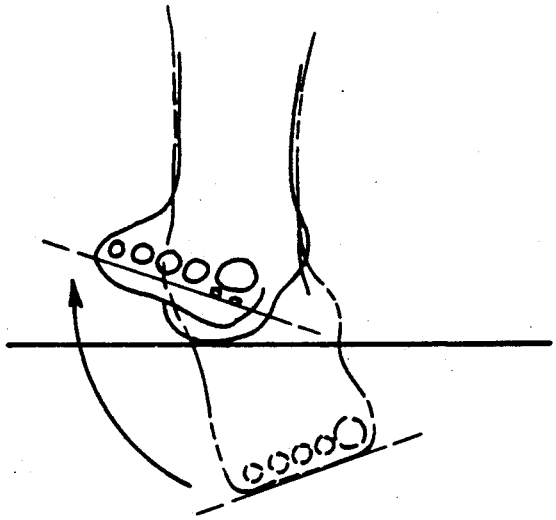
FIG. 10 is an illustration of eversion/dorsiflexion.

FIG. 1 shows an example of a device according to the invention secured to a right foot. The same device could, as well, be secured to a left foot. It comprises a rigid foot-engaging member or foot orthosis 1, a better view of which can be obtained from FIG. 2. The orthosis is responsible for attaching snugly to the foot, and provides the point of attachment for the distal aspect of the fluid chambers 6 and 7. Its basic construction is much like that of a functional orthosis used in the treatment of pedal mechanical abnormalities, with some changes. It must be all one piece and have no sharp edges. Ideally it should be molded to the foot in a more or less neutral subtalar joint position. It should cup the heel, and the rim of the heel cup should come up superiorly in the medial, lateral and posterior aspects of the calcaneus, much like a normal heel counter of a shoe. Anterior to the heel "wings" 2 and 3 extend medially and laterally in the transverse plane, extending from the level of the navicular tuberosity medially, and the styloid process of the 5th metatarsal base laterally. The reason that these two points are used is that anatomically, these two points serve as the attachments for the muscle tendons primarily involved in the motion whose integrity has been lost, and to which rehabilitation is directed. Medially, the posterior tibial tendon is the primary invertor of the foot, and laterally, the peroneus brevis is the primary evertor of the foot. Therefore these two points will be the points of greatest force in the range of motion, and the places where resistance will be most beneficial. Because these two points are at the same level in the transverse plane, it is possible to fashion a device which is more or less symmetrical about its long axis, and can therefore be used on either foot.

As important as the placement of the wings is the distance they will protrude from the body of the orthotic. The limitations involved are as follows: (1) The device must satisfy the full range of motion of inversion and eversion of the average athlete. (2) The frontal plane excursion of the end of the wing must not be so great as to exceed the stroke length of the fluid chamber, so as not to reach an end point of motion of the machine prior to that of the actual joint involved. (3) At the end of the range of motion, the fluid chamber on the opposite side of the ankle cannot touch the ankle itself. As an example, when the subtalar joint is fully inverted, the fluid chamber on the lateral side must not hit the lateral side of the ankle. This may be seen most clearly in FIGS. 11 and 12.

The preferred extension of the wing (2 or 3) allows the fluid chamber (6 or 7) to be attached a distance of 6.35 cm from the side of the foot. However, an extra 1.25 cm is added to the end of the wing to accommodate for a hole corresponding to the bolt end of the fluid chamber, which will be attached at this point.

The width of the wing in the transverse plane is preferably approximately 2.5 cm anterior to posterior. Distally the orthosis should end just proximal to the metatarsal heads, in a rounded and symmetrical fashion. If the device is extended over the metatarsal heads, several other muscle tendons would become involved, (extensor halluces longus and peroneus longus) which would interfere with the primary rehabilitation goals.

The preferred material for fashioning the foot-engaging member is 16 gauge steel, although composite would also be suitable. Whatever material is used should be able to withstand the force of muscle contractions without deformation. Additional material can be used as a buttress, extending from the plantar aspect of the body of the orthotic to the tip of the wing and encompassing the means for attaching the fluid chamber.

For snug attachment to the foot, two slots are cut into the body of the orthosis oriented longitudinally, extending approximately 38 to 50 mm in length and 6 to 7 mm in width, centered at the level of the wings. They should be located 38 mm medially and laterally from the longitudinal midline of the body of the orthosis, i.e., 7.6 cm apart. A foot strap is inserted through these slots. One single strap of 5 cm wide stiff nylon is inserted from inside to outside on the medial side and then from outside to in on the lateral side, thus making the plantar part of the strap on the outer part of the orthosis, and the portion of the strap that will create the closure inside the wings on the transverse plane. The strap ideally has a hook-and-pile closure of the type known as VELCRO and should have some sort of padding (e.g., plastazote) on the underside of the strap for comfort to the user.

The leg closure 12 and 13, which for the purpose of this discussion we will call the brace, will serve as the stabilizer and will provide the point of attachment for the proximal portion of the chambers. Since its role is that of a stabilizer, it must have as little motion as possible. The brace is preferably made of two solid brace elements 12 and 13 and two straps 14 and 16. The brace element should be of a very stiff plastic, composite, or 16 gauge stainless steel. Each element is formed from a 10 cm by 10 cm square curved along one axis of the square to form a 120° arc of a circle. In other words, each of the two elements is a ⅓ section of a cylinder 10 cm high and about 9 to 10 cm in diameter. The edges and corners are rounded to avoid cutting the user. The proximal portion extends from the most distal edge of the gastrocnemius muscle distally 10 cm. One brace element 12 is positioned on the medial aspect and one element 13 on the lateral aspect of the leg. On the inner surface of the brace is a layer of resilient material (e.g., ¼ inch PPT) whose margins should slightly overhang the outer margins of the brace. At the geometric center of each brace element, protruding out from the surface is a means for attaching the rod 8 and 9 of the fluid chamber. In the example shown, the means are eyerings 10 and 11, oriented in the transverse plane, whose size will correspond to the eyering of the rod. The strength of the attachment of the eyering to the main brace is critical since great force will be transmitted through this joint.

In order to stabilize the brace, and to complete the enclosure, two straps are necessary. To accommodate the straps, four slots are made in each brace element: two above the eyering and two below. In the embodiment shown, each slot is 2.54 cm from the eye ring in the sagittal plane, two anterior and two posterior, 6 mm superior and inferior to the plane of the ring, oriented vertically 3.8 cm with an opening approximately 6 mm. This allows for the passage of the straps. The straps are preferably made of a stiff nylon, 3.8 cm wide, with a hook-and-pile closure system which will close in the front. Each strap is threaded around the brace outside the brace in the front and back portions and slotted to the inner portion, between the brace and underlying resilient material for the 5 cm between the two slots.

Fluid chambers or cylinders 6 and 7 and their associated rods 8 and 9 are pivotally attached to the brace elements 12 and 13 at attachment points 10 and 11 and to the foot-engaging means 1 at points 4 and 5 on wings 2 and 3 respectively. Means for pivotally attaching are well-known in the art and include, bolts, pins, hinges, rivets, and the like.

The fluid cylinders are of such a design as to allow regulation of the resistance to motion of the piston within the cylinder. They may be pneumatic or, preferably, hydraulic cylinders. The resistance should be adjustable between about 4 Newtons (1 lb.) and 220 Newtons (50 lbs.). The preferred cylinder (6 or 7) is 1 to 2 cm in diameter and about 20 cm long with rods of comparable diameter and length. This allows a travel of about 20 cm (8 inches) between the two extreme positions.

In operation, the method of strengthening or rehabilitating an ankle with the device utilizes the principles of hydraulics. As a model, one can think of a shock absorber. A shock absorber is a velocity sensitive device. It is sensitive to stroke speed by automatically varying the resistance directly proportional to the speed of compression, thereby varying the amount of force needed to achieve the same displacement. An example is a person on an exercise rowing machine. A beginner can move the lever arms of the machine very slowly and only uses a minimum of effort. When the speed increases, so does the level of resistance in the shock absorber, forcing the individual to apply more force to travel the same distance.

Similarly, in ankle rehabilitation, in the initial stages after an acute injury, the ankle is painful and range of motion is guarded, and there is very little strength. The force that can be applied is small; therefore the speed of muscle contraction will be very slow, and the resistance should be low. As the affected part gets stronger, more force can be applied, increasing the speed of contraction, and automatically increasing the resistance to that speed. Since the amount of force through the range of motion varies as the muscle lengths change, and will not be the same through that full range of motion, it is important that the machine vary the resistance automatically to create even overload of muscles throughout the full range. Taking this concept one step further, fatigue will create a decrease in the amount of force generated by the affected part, therefore again it is important that the machine be sensitive to these changes. This is the advantage of the fluid chamber device.

The device of the invention is able to isolate the ankle and subtalar joint complex and exercise those muscles directly responsible for inversion and eversion of the subtalar joint as well as those responsible for dorsal and plantar flexion of the ankle joint. The device uses fluid chambers for hydraulic resistance, a modified foot orthosis to create the proper mechanical advantage to allow the chambers to effectively resist the proper muscles, and a leg brace to isolate the ankle and subtalar joint.

While the invention has been particularly shown and described with reference to preferred embodiments thereof, it will be understood by those skilled in the art that other changes in form and details may be made therein without departing from the spirit and scope of the invention.

I claim,

1. A device for the physical therapy of an ankle joint comprising:

(a) a rigid, foot-engaging member for attaching snugly to a foot, said foot-engaging member including first and second rigid wings extending medially and laterally from said foot, said first wing having a means for pivotally attaching a first fluid chamber and said second wing having means for pivotally attaching a second fluid chamber;

(b) a first fluid chamber structure comprising a cylinder, a piston, and a piston rod, the travel of said piston through the full length of said cylinder defining one stroke, one of said cylinder and said rod being attached to said fluid chamber attaching means on said first foot-engaging member wing;

(c) a second fluid chamber structure comprising a cylinder, a piston, and a piston rod, the travel of said piston thru the full length of said cylinder defining one stroke, one of said cylinder and said rod being attached to said fluid chamber attaching means on said second foot engaging member wing;

(d) a leg enclosure for attaching snugly to a leg at a point between an ankle and a knee, said leg enclosure having first and second means for pivotally attaching said first and second fluid chamber structures respectively at the other of said cylinder and said rod; said first and second foot-engaging member wings extending outwardly a sufficient distance such that said points of attachment of said first and second fluid chambers induce travel of said piston in said cylinder by normal inversion and eversion of said foot.

2. A device according to claim 1 wherein said first wing means for pivotally attaching a fluid chamber is at a point medially substantially in the frontal and transverse planes and opposite the navicular tuberosity and said second wing means for pivotally attaching a fluid chamber is at a point laterally substantially in the frontal and transverse planes and opposite the styloid process of the 5th metatarsal base.

3. A device according to claim 1 wherein said first and second wings extend outwardly a sufficient distance such that said points of attachment induce travel of said piston through not less than 20% of a stroke by normal inversion and eversion of said foot.

4. A device according to claim 3 wherein said points of attachment of said fluid chambers to said wings are a distance of 5 to 13 cm from said foot, and said points of attachment on said wings are about 17 to about 20 cm from said means for attaching said fluid chambers to said leg enclosure.

5. A device according to claim 1 wherein said foot-engaging member includes strap means for securing a foot in a firm and aligned position.

6. A device according to claim 1 further comprising means for regulating resistance of fluid movement within said fluid chamber structures.

7. A device according to claim 1 wherein said first and second rigid wings extend medially and laterally along an axis substantially in the frontal and transverse planes.

8. A device according to claim 1 wherein said first and second means for attaching said fluid chamber structures to said leg enclosure are located along a common axis substantially in the frontal and sagittal planes, said axis passing through said leg.

9. A method for strengthening an ankle comprising:

(a) securing opposite ends of a pair of fluid chambers to a foot and lower leg respectively such that inversion, eversion, dorsal flexion and plantar flexion of said foot with respect to said leg result in compression and extension of said fluid chambers, and (b) inverting, everting and flexing said foot against a resistance provided by said chambers.

* * * * *